United States Patent [19]

Tanaka et al.

[11] 4,239,478

[45] Dec. 16, 1980

[54] CHECK CIRCUIT FOR COMBUSTION PROCESS CONTROL TIMER

[75] Inventors: Toshio Tanaka, Toride; Sumio Nakagawa, Tokyo, both of Japan

[73] Assignee: Hitachi, Ltd., Japan

[21] Appl. No.: 940,369

[22] Filed: Sep. 7, 1978

[30] Foreign Application Priority Data

Sep. 16, 1977 [JP] Japan ..... 52/110587

[51] Int. Cl.[3] ..... F23N 5/24; F23Q 23/00; F23Q 9/08; F23N 5/00

[52] U.S. Cl. ..... 431/24; 431/15; 431/26; 431/73

[58] Field of Search ..... 431/15, 24, 26, 31, 431/51, 71, 73, 66, 67, 78, 80

[56] References Cited

U.S. PATENT DOCUMENTS

| | | | |
|---|---|---|---|
| 3,541,549 | 11/1970 | Graves | 431/24 |
| 3,553,664 | 1/1971 | Tucker | 431/24 |
| 3,574,495 | 4/1971 | Landis | 431/26 |
| 3,849,056 | 11/1974 | Schuss | 431/24 |
| 3,958,126 | 5/1976 | Bryant | 431/24 |
| 4,078,879 | 3/1978 | Dietz | 431/26 |
| 4,087,046 | 5/1978 | Borucki | 431/24 |
| 4,101,258 | 7/1978 | Jacobsz | 431/26 |
| 4,116,613 | 9/1978 | Matthews | 431/26 |

*Primary Examiner*—George E. Lowrance
*Attorney, Agent, or Firm*—Craig and Antonelli

[57] ABSTRACT

A check circuit for checking operation of timers of a digital type combustion process control apparatus comprises flip-flops each having a preset terminal. The preset state of the flip-flops is inverted by an operation starting signal. The inversion is detected by a detector circuit the output signal of which is utilized for driving the control circuits for a combustion apparatus. The detector circuit is composed of a flip-flop circuit having input terminals applied with the operation initiating signal and the inverted output signal from the timer circuit.

13 Claims, 2 Drawing Figures

CHECK CIRCUIT FOR COMBUSTION PROCESS CONTROL TIMER

BACKGROUND OF THE INVENTION

The present invention relates in general to a digital timer employed in a combution control apparatus for controlling combustion process in a burner used in hot water heaters, hot air furnaces, or the like. In particular, the invention concerns a circuit for checking the timer in respect of operation at the beginning of the operation of the combustion apparatus.

In general, the combustion control apparatus is provided with two types of timers. One timer is used for controls. For example, the timer is used for setting a period of time in during which the air in the combustion chamber is purged prior to the fuel supply or setting a predetermined period of time during which the igniting device is continued to operate. The other timer is a so-called safety timer which is destined for stopping the operation of the combustion apparatus in the case where firing does not take place during a predetermined period of time after the initiation of the igniting operation. More particularly, the safety timer inhibits the injection of fuel upon failure of ignition thereby to stop the operation of the combustion apparatus.

These timers are usually constituted by flip-flop circuits. Assume now the case where failure or malfunction occurs in these timers so that frequency dividing operation can not be effected. In particular, there arises a very serious situation in the case of failure or malfunction of the safety timer, as will be appreciated from the function imposed on the safety timer described above. For example, assuming that the timing operation of the safety timer becomes ineffective and the time preset by the timer increases indefinitely, the ignition failure, if happens, will causes the fuel to be continuously discharged without combustion. On the other hand the failure of the control timer will give rise to instantaneous firing at the initiation of operation without the prepuriging process being interposed, possibly involving explosion due to the ignition of the remaining combustible gas.

SUMMARY OF THE INVENTION

An object of the invention is to provide a check circuit which is intended for use in combination with the timers to check the operativeness of the flip-flop circuits constituting the timers immediately after the initiation of operation and subsequently cause the timers to perform sequential routine operation, thereby to eliminate the disadvantages of the hitherto known timers described above.

DETAILED DESCRIPTION OF THE PREFERRED EMBODIMENTS

Figure 1:
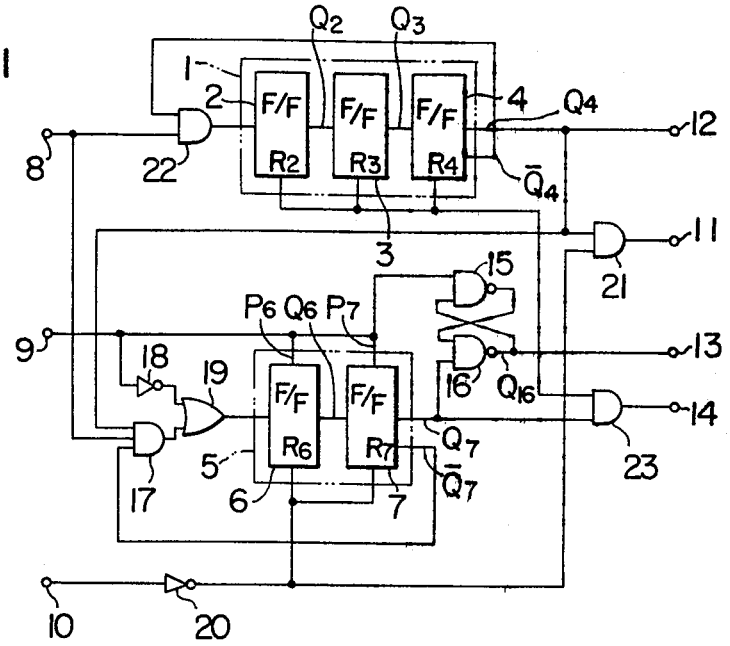
FIG. 1 is a schematic circuit diagram of an embodiment of a timer checking circuit according to the invention.

In the following description, various signals appearing at various circuit points such as input and output terminals are labelled with same reference symbols or numerals as attached to the corresponding circuit points for simplification of the description. For example, reference clock pulse applied to the input terminal 8 for such reference clock pulse is denoted by the reference numeral 8.

In general, the combustion control system of this type is constituted by various timers and input circuits for operating the timers in response to various input signals such as operation initiating signal and controls operations of various external apparatus such as a igniting device, a fuel supply valve, etc.

Referring to FIG. 1 which shows an exemplary embodiment of a check circuit for a safety timer which is used in combination with a control timer destined only for timing the prepurge process in a combustion apparatus. The control timer 1 is constituted by flip-flops 2, 3 and 4 for division of frequency, while the safety timer 5 is composed of flip-flops 6 and 7 having preset terminals $P_6$ and $P_7$, respectively. The flip-flops 2, 3, 4, 6 and 7 have respective output terminals $Q_2$, $Q_3$, $Q_4$, $Q_6$ and $Q_7$. Further, the final stage flip-flop 4 of the control timer circuit has a complementary or inverted output $\overline{Q_4}$, while the final stage flip-flop 7 of the safety timer circuit 5 has additionally the complementary or inverted output $\overline{Q_7}$. The flip-flops 2, 3, 4, 6 and 7 have respective reset terminals $R_2$, $R_3$, $R_4$, $R_6$ and $R_7$. In response to the reset signal of logic "0" level applied to these reset terminals, the flip-flops 2, 3, 4, 6 and 7 are reset to the output states of logic "0" at the output terminals $Q_2$, $Q_3$, $Q_4$, $Q_6$ and $Q_7$. In the safety timer circuit 5, when the preset inputs $P_6$ and $P_7$ to the flip-flops 6 and 7 are logic "0's", the outputs $Q_6$ and $Q_7$ thereof will become logic "1's", respectively. In FIG. 1, reference numeral 8 denotes a reference clock pulse, 9 designates an operation initiating signal and 10 denotes a flame detecting signal. Reference numeral 11 denote an output signal applied to an ignition apparatus, 12 denotes an output signal for controlling an operation of an electromagnetic fuel supply control valve, 13 denotes an output signal for controlling operation of a combustion air supply fan or blower and 14 denotes an output signal which is produced upon the failure of ignition and applied to an alarm apparatus. The signals appearing at these terminals 11, 12, 13 and 14 are supplied to external driver circuits (not shown) for the respective apparatus (not shown), i.e. an ignition apparatus, an electromagnetic fuel control valve, a fan and an alarm device (not shown).

In operation, when the operation initiating signal 9 is at logic "O" level, the preset input $P_6$ and $P_7$ of logic "0" will result in the output $Q_7$ at logic "1" level from the flip-flop 7 as well as the output $Q_{16}$ at logic "0" level from the R-S flip-flop constituted by NAND gates 15 and 16, as the result of which the outputs 11 to 14 are all at logic "0" level.

When the operation initiating signal 9 is turned on to the logic level "1" to command the initiation of operation, the preset function is released. However, the outputs $Q_6$ and $Q_7$ tend to remain at the logic "1" level. On the other hand, the output of an inverter 18 which has been at logic "1" in response to the operation initiating signal 9 of logic "0" and applied to the flip-flop 6 through an OR gate 19 is changed to logic "0" in response to the change in the logic level from "0" to "1" of the operation initiating signal 9, while the output of AND gate 17 is at logic "0" at this time. Thus, since both the inputs of OR gate 19 are of logic "0's" the output from OR gate 19 becomes at logic "0" and is applied to the flip-flop 6 which will then invert the state thereof. The succeeding flip-flop 7 will respond to the output $Q_6$ of the preceeding flip-flop 6 to invert the state, whereby the outputs $Q_6$ and $Q_7$ both become logic "0's". Consequently, the output $Q_{16}$ of R-S flip-flop constituted by NAND circuits 15 and 16 is inverted to logic "1" from "0". Normal combustion process is initiated by this logic "1" output $Q_{16}$ from the R-S flip-flop. More particularly, the logic "1" output $Q_{16}$ will trigger the timing operation of the timer circuit 1 and at the same time initiate the operation of the blower fan (not shown) from the fan output terminal 13.

In more detail, when the output terminal 13 becomes at logic "1" level, the blower or fan for supplying combustion sustaining air is operated, whereby the prepurging of the combustion chamber of a burner is effected. Simultaneously, the reset conditions of the flip-flops 2, 3 and 4 are cleared to produce the complementary output $\overline{Q_4}$ at logic "1" level, as a result of which AND gate 22 is enabled to allow the flip-flops 2, 3 and 4 to perform frequency dividing operation of the clock pulse signal 8. When the output $Q_4$ becomes logic "1", the output signal 12 for driving the electromagnetic fuel supply control valve (not shown) will change its logic level from "0" to "1" thereby to initiate the fuel supply. Under these conditions, ignition does not yet take place, the flame is not detected and thus the flame detecting signal 10 remains logic "0" which is then inverted to logic "1" through an inverter 20 and applied to AND gate 21 together with the output signal $Q_4$ from the flip-flop 4 which is now at logic "1" level. Thus, the output from AND gate 21, namely the output 11 for igniting apparatus, becomes logic "1" and is applied to the igniting apparatus (not shown) to initiate the igniting operation. At this time, the complementary or inverted output $\overline{Q_4}$ of the flip-flop 4 becomes logic "0", whereby AND gate 22 becomes non-conductive and the clock pulse 8 will be no more supplied to the flip-flops 2, 3 and 4. On the other hand, the AND gate 17 is enabled in response to the input $\overline{Q_7}$ and $Q_4$ at the logic "0" level. Accordingly, the flip-flops 6 and 7 of the safety timer circuit 5 are supplied with the clock pulse signal 8 through AND gate 17 and OR gate 19 thereby to start the frequency dividing operation. After the initiation of the igniting operation, when the flame is detected and the flame detection signal 10 becomes logic "1" before the output $Q_7$ of the flip-flop 7 is turned to logic "1", both of the flip-flops 6 and 7 will be reset as accompanied by the resetting of the output signal 11 for the igniting apparatus to the logic "0" level. If the ignition does not take place and thus involves the logic "1" level at the output $Q_7$ of the flip-flop 7, AND gate 23 having the other input $Q_{16}$ at the logic "1" level will then produce the output of logic "1" appearing at the alarm output terminal 14, as a result of which the operation of the combustion apparatus is stopped and/or alarm signal will be produced. The function of AND gate 23 is to suppress the generation of alarm output 14 at the time of preset operation.

If combustion is interrupted or extinction occurs for some reasons, during the normal operation, the flame detection signal 10 will become logic "0", resulting in the output of logic "1" from the inverter 20 to clear the reset condition from the flip-flops 6 and 7 which will then start the frequency dividing operation again. Simultaneously, the output signal 11 for the igniting apparatus will becomes logic "1" and the succeeding operations described above will be repeated.

As will be appreciated from the foregoing description, the operations of the combustion system is initiated by the output $Q_{16}$ of the logic "1" level so far as the flip-flops 6 and 7 of the timer 5 are in the normal conditions. However, when either one of the flip-flops 6 and 7 is in failure and the frequency dividing operation becomes ineffective, the output $Q_7$ will continue to remain at the logic "1" level even if the operation initiating signal 9 is turned on to the level "1". Consequently, the output $Q_{16}$ will also remain constantly at logic "0" level. The normal operation sequence is thus inhibited from being initiated. However, when the failure is of such nature that the output $Q_7$ from the final stage flip-flop 7 holds consistently the output state of logic "0", the check described above can not be effected.

Thus, according to the invention, it is possible to conduct the check for the safety timer in a satisfactory manner, a failure of which is most dangerous in the combustion control as described hereinbefore, thereby the control for the combustion processes can be carried out with an enhanced reliability and increased safety by merely adding a few logic gates to the conventional timer circuit.

Figure 2:
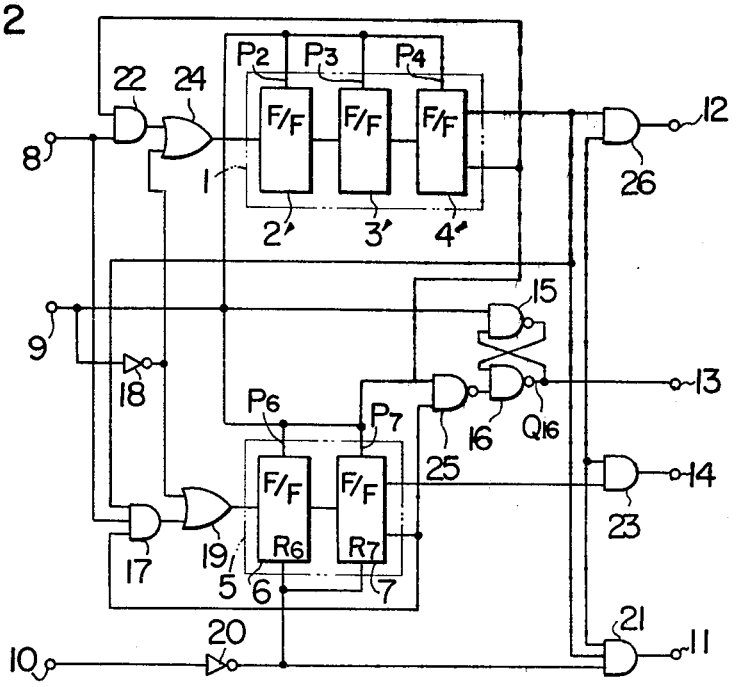
FIG. 2 is a block diagram showing another embodiment of the invention.

The check circuit shown in FIG. 2 is so designed as to check both the control timer and the safety timer according to the invention. The control timer 1 is constituted by flip-flops 2', 3' and 4' having respective preset terminals $P_2$, $P_3$ and $P_4$ with OR gate 24 disposed between the set terminal of the timer 1 and AND gate 22, wherein the operation initiating signal 9 is applied to the set terminal of the timer circuit 1 through the inverter 18 and OR gate 24. It will be noted that the output $Q_{16}$ of the flip-flop constituted by NAND gates 15 and 16 is not connected to the reset terminals $R_2'$, $R_3'$ and $R_4'$ of the flip-flops 2', 3' and 4' constituting the control timer 1 in contrast to the case of the first embodiment shown in FIG. 1. The checking process is effected in the similar manner as is in the case of the first embodiment. The function of NAND gate 25 is to invert the state of the flip-flop constituted by NAND gates 15 and 16 only after both of the control and the safety timer circuits 1 and 5 have been checked and found to be normally functional. Numeral 26 denotes AND gate. With the circuit arrangement shown in FIG. 1, the respective reset terminals for the control timer 1 can be spared. Further, the possibility of instantaneous ignition due to failure in the control timer can be positively excluded.

We claim:

1. A check circuit for checking operation of a timer for producing various timing signals to control combustion processes by dividing frequency of a reference clock pulse signal comprising:

a first input terminal for receiving an external reference clock pulse signal;

a second input terminal for receiving an external command signal for commanding initiation of the combustion processes;

a first timer circuit constituted by a plurality of flip-flops arranged to produce a predetermined timing by dividing frequency of said reference clock signal, said first timer circuit including a clock input terminal and an output terminal, each of said flip-flops having a preset terminal connected to said second input terminal;

a first logic gate having inputs respectively connected to said first and second input terminals and an output connected to said clock input terminal of said first timer circuit for inverting the state of said first timer circuit in response to said combustion process initiation command signal;

a flip-flop circuit having input terminals respectively connected to the output terminal of said first timer circuit and said second input terminal; and a first output terminal connected to the output terminal of said flip-flop circuit thereby to supply the output signal of said flip-flop circuit as a first driving signal to a first external control circuit to be connected to said first output terminal.

2. A check circuit as set forth in claim 1, further comprising a first AND gate having input terminals respectively connected to said output terminal of said flip-flop circuit and said output terminal of said first timer circuit, and a second output terminal connected to an output of said first AND gate for supplying the output signal of said first AND gate as a second driving signal to a second external circuit to be connected to said second output terminal.

3. A check circuit as set forth in claim 2, wherein said first external circuit is provided for controlling the operation of an external combustion air blower, while said second control circuit is provided for driving an external alarm apparatus for indicating ignition failure.

4. A check circuit as set forth in claim 1, further comprising a second timer circuit having a clock input terminal connected to said first input terminal to divide the frequency of said reference clock pulse signal, the output terminal of said flip-flop circuit being connected to a reset terminal of said second timer circuit thereby to utilize the output signal of said flip-flop circuit as a start signal for said second timer circuit, and further comprising a second output terminal connected to the output terminal of said second timer circuit for supplying the output signal of said second timer circuit as a second driving signal to a second external control circuit to be connected to said second output terminal.

5. A check circuit as set forth in claim 4, wherein said first external control circuit is provided for controlling operation of an external combustion air blower, while said second external control circuit is provided for controlling operation of an external electromagnetic valve for fuel supply.

6. A check circuit as set forth in claim 2, further comprising a second timer circuit having a clock input terminal connected to said first output terminal to divide the frequency of said reference clock pulse signal, the output terminal of said flip-flop circuit being connected to a reset terminal of said second timer thereby to utilize the output signal of said flip-flop circuit as a starting signal for said second timer circuit, and further comprising a third output terminal connected to the output terminal of said second timer circuit for supplying the output signal of said second timer circuit as a third driving signal to a third external control circuit to be connected to said third output terminal.

7. A check circuit as set forth in claim 6, wherein said first, second and third control circuits are provided for respectively controlling operations of an external combustion air blower, an external alarming apparatus for indicating ignition failure and an external electromagnetic valve for fuel supply.

8. A check circuit as set forth in claim 6, further comprising a third input terminal for receiving a flame detection signal representative of presence of flame, a second AND gate having input terminals respectively connected to the output terminal of said second timer circuit and said third input terminal, and a fourth output terminal connected to the output of said second AND gate for supplying the output of said second AND gate as a fourth drive signal to a fourth external control circuit to be connected to said fourth output terminal.

9. A check circuit as set forth in claim 8, wherein said first, second, third and fourth external control circuits are provided for respectively controlling operations of an external combustion air blower, an external alarm apparatus for indicating ignition failure, an external electromagnetic valve for fuel supply and an external igniting apparatus.

10. A check circuit as set forth in any one of said claims 1 to 9, wherein said logic gate circuit includes a third AND gate having input terminals respectively connected to an inverted output terminal of said first timer circuit and said first input terminal, and an OR gate having input terminals respectively connected to the output terminal of said third AND gate and said second input terminal through an inverter, the output of said OR gate being produced as the output of said first logic circuit.

11. A check circuit as set forth in claim 1, further comprising:

a second timer circuit constituted by a plurality of flip-flops to produce a predetermined timing by diving the frequency of the reference clock pulse signal, said second timer including a clock input terminal and an output terminal, each of said flip-flops of said second timer circuit being provided with a preset input terminal connected to said second input terminal;

a second logic gate circuit having input terminals respectively connected to said first and second input terminals and having an output terminal connected to the clock input terminal of said second timer circuit, the state of said second timer circuit being inverted in response to said combustion process initiation command signal; and a third logic gate adapted to be enabled by the output of said second timer circuit to conduct the output signal of said first timer circuit to said flip-flop circuit.

12. A check circuit as set forth in claim 11, further comprising a first AND gate having input terminals respectively connected to the output terminal of said flip-flop circuit and the output terminal of said first timer, a second output terminal connected to the output terminal of said first AND gate for supplying the output signal of said second AND gate as a second driving signal to a second external control circuit to be connected to said second output terminal, a second AND gate having input terminals respectively connected to the output terminal of said flip-flop circuit and the output terminal of said second timer circuit, a third output terminal connected to the output terminal of said second AND gate for supplying the output signal of said second AND gate as a third driving signal to a third external control circuit to be connected to said third output terminal, a third input terminal for receiving an external signal representative of presence of flame, a third AND gate having input terminals respectively connected to the output terminal of said second timer circuit, said third input terminal and the output terminal of said flip-flop circuit, and a fourth output terminal connected to the output of said third AND gate for supplying the output signal of said third AND gate as a fourth driving signal to a fourth external control circuit to be conntected to said fourth output terminal.

13. A check circuit as set forth in claim 12, wherein said first, second, third and fourth external control circuit are provided for respectively controlling operations of an external combustion air blower, an external alarm apparatus for indicating ignition failure, an external electromagnetic valve for fuel supply and an external igniting apparatus.

* * * * *